US010655324B2

(12) United States Patent
Hettler et al.

(10) Patent No.: US 10,655,324 B2
(45) Date of Patent: May 19, 2020

(54) FOLDED FOAM SHEATHING WITH STARTER STRIP

(71) Applicant: Owens Corning Intellectual Capital, LLC, Toledo, OH (US)

(72) Inventors: Neil Robert Hettler, Granville, OH (US); Matthew Gawryla, Chagrin Falls, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 16/208,899

(22) Filed: Dec. 4, 2018

(65) Prior Publication Data

US 2019/0145097 A1 May 16, 2019

Related U.S. Application Data

(63) Continuation of application No. 15/199,281, filed on Jun. 30, 2016, now abandoned.

(60) Provisional application No. 62/186,451, filed on Jun. 30, 2015.

(51) Int. Cl.

| | |
|---|---|
| ***E04B 1/80*** | (2006.01) |
| ***E04C 2/40*** | (2006.01) |
| ***E04C 2/20*** | (2006.01) |
| ***E04C 2/32*** | (2006.01) |
| ***E04C 2/284*** | (2006.01) |

(52) U.S. Cl.

CPC ..... *E04B 1/80* (2013.01); *E04C 2/205* (2013.01); *E04C 2/284* (2013.01); *E04C 2/328* (2013.01); *E04C 2/405* (2013.01)

(58) Field of Classification Search

CPC ..... E04B 1/80; E04B 1/7675; E04C 2/328; E04C 2/405; E04C 2/205

USPC ... 52/745.05, 745.09, 745.1, 745.11, 745.13, 52/745.14, 745.2, 746.1, 506.01, 408

See application file for complete search history.

(56) References Cited

U.S. PATENT DOCUMENTS 2,631,644 A * 3/1953 Cole ..... E04B 1/80 428/121
2,782,914 A 2/1957 Giles
3,165,791 A 1/1965 Valsvik
(Continued)

FOREIGN PATENT DOCUMENTS

JP 04303640 A * 10/1992

OTHER PUBLICATIONS

Office Action from U.S. Appl. No. 15/199,281 dated Apr. 12, 2017.
(Continued)

*Primary Examiner* — Brent W Herring
(74) *Attorney, Agent, or Firm* — Calfee, Hatler & Griswold LLP

(57) ABSTRACT

An exemplary foam insulation board includes a plurality of insulation panels hingeably connected by hinged portions. The foam insulation board has a folded configuration and an unfolded configuration. The hinged portions allow the insulation panels to fold flat against each other in the folded configuration. The plurality of insulation panels includes a first insulation panel and a plurality of additional insulation panels, one of which is adjacent to the first insulation panel. The first insulation panel also includes a starter portion that extends beyond at least the adjacent insulation panel of the additional panels.

20 Claims, 9 Drawing Sheets

(56) References Cited

U.S. PATENT DOCUMENTS 3,284,819 A 11/1966 Nissen
3,323,151 A 6/1967 Lerman
3,535,834 A * 10/1970 Nichols ..... E04B 1/3205 52/69
3,636,576 A 1/1972 Nissen
3,649,398 A 3/1972 Keith
3,717,247 A 2/1973 Moore
3,731,440 A * 5/1973 Welz ..... E04B 1/3444 52/71
3,755,031 A 8/1973 Hoffman et al.
3,826,055 A 7/1974 Bobzin et al.
3,832,263 A 8/1974 Cleveland et al.
3,958,385 A 5/1976 Bondra et al.
4,074,475 A * 2/1978 Wahlquist ..... E04B 1/3445 52/143
4,077,823 A 3/1978 Wright
4,118,901 A * 10/1978 Johnson ..... E04B 1/3445 52/18
4,154,041 A * 5/1979 Namy ..... E04B 1/681 52/284
4,361,995 A 12/1982 Buck et al.
4,428,898 A 1/1984 Buck et al.
D274,493 S 7/1984 Dyby
4,480,715 A 11/1984 Brooks
4,494,348 A 1/1985 Kastelic
4,543,765 A * 10/1985 Barrett ..... E04F 13/0862 428/138
4,912,891 A * 4/1990 Bertrand ..... E04B 1/3444 52/66
4,985,952 A 1/1991 Edelson
5,272,848 A * 12/1993 Maas ..... A47G 5/00 160/135
5,515,900 A 5/1996 West et al.
5,950,260 A 9/1999 Dees
6,185,895 B1 2/2001 Rettew
6,383,594 B2 * 5/2002 Weinstein ..... B32B 5/26 428/43
6,468,615 B2 * 10/2002 Weinstein ..... B32B 3/08 428/124
6,618,883 B2 9/2003 Angland
6,711,766 B2 3/2004 Monk et al.
6,715,530 B2 * 4/2004 Goldsmith ..... E05D 15/26 160/199
7,117,645 B2 * 10/2006 Bzorgi ..... E04B 1/3442 52/79.5
7,222,705 B1 5/2007 Guza
7,690,158 B2 4/2010 Kelly
D674,225 S 1/2013 Boyer
8,347,562 B2 1/2013 Morris et al.
8,534,003 B2 9/2013 Curry, III
8,567,840 B2 * 10/2013 Mirabella ..... B60R 13/01 296/39.1
8,595,987 B2 * 12/2013 Curry, III ..... E04C 2/284 52/592.1
8,782,982 B2 * 7/2014 Lewis ..... E04B 1/7654 52/407.3
9,048,530 B2 6/2015 Kellberg
9,512,618 B2 12/2016 Lang et al.
2003/0010372 A1 1/2003 Dinwoodie
2003/0221256 A1 12/2003 Monk et al.
2004/0250490 A1 12/2004 Hall
2007/0272373 A1 * 11/2007 Curry, III ..... E04C 2/284 160/230
2007/0275827 A1 11/2007 Glaser
2008/0058165 A1 3/2008 Schletti
2008/0118671 A1 5/2008 Bienkiewicz
2009/0025135 A1 1/2009 Huber
2009/0321023 A1 12/2009 Curry, III
2010/0229487 A1 9/2010 Lewis
2011/0146183 A1 * 6/2011 Wilkens ..... E04B 9/0414 52/506.06
2011/0271626 A1 * 11/2011 Lewis ..... E04B 1/7654 52/407.3
2011/0316301 A1 * 12/2011 Mirabella ..... B60R 13/01 296/39.1
2012/0227916 A1 9/2012 Kellberg
2013/0276385 A1 10/2013 White
2015/0140253 A1 5/2015 Lang et al.
2016/0129299 A1 5/2016 Newman
2017/0081869 A1 3/2017 Huber

OTHER PUBLICATIONS

Office Action from U.S. Appl. No. 15/199,281 dated Dec. 6, 2017.
Office Action from U.S. Appl. No. 15/199,281 dated Mar. 28, 2018.
Office Action from U.S. Appl. No. 15/199,281 dated Aug. 16, 2018.
Office Action from MX Application No. MX/a/2016/008706 dated Jul. 29, 2019.

* cited by examiner

FOLDED FOAM SHEATHING WITH STARTER STRIP

CROSS REFERENCE TO RELATED APPLICATIONS

This application is a continuation of U.S. application Ser. No. 15/199,281, filed Jun. 30, 2016, which claims priority to and the benefit of U.S. Provisional Application Ser. No. 62/186,451, filed Jun. 30, 2015, the entire disclosures of which are incorporated herein by reference in full.

FIELD

The present invention relates generally to foam insulation boards, such as foam insulation boards for installation in a residential structure.

BACKGROUND

In constructing a building, and in particular a residential building like a house, a relatively thin panel board is commonly used to cover the structural framework of exterior walls. The board is typically fabricated from a low-cost, lightweight material having enhanced insulating properties, such as, for example, extruded or expanded polystyrene, polyisocyanuarate, or polyurethane foam. Usually, the boards are sized for use in conjunction with conventional frame selections (that is, frames with wooden studs on 16 inch or 24 inch centers). The boards may also have varying thickness and compositions, depending on, among other considerations, the desired resistance to heat flow.

In some applications, an air and water or moisture barrier is provided between the interior and the exterior of the building. Generally, the barrier system is configured to "seal" the entire structure. This air and moisture barrier may be achieved using a layer of a plastic sheet known as a water resistive barrier in conjunction with the boards. In the alternative, the air and moisture barrier may also be achieved by affixing an adhesive carrier such as tape over the joints where the boards abut one another.

SUMMARY

Exemplary embodiments of foam insulation board and methods of installing the same are disclosed herein.

In one exemplary embodiment, a foam insulation board comprises a plurality of insulation panels hingeably connected by hinged portions. The foam insulation board has a folded configuration and an unfolded configuration. The hinged portions allow the insulation panels to fold flat against each other in the folded configuration. The plurality of insulation panels includes a first insulation panel and a plurality of additional insulation panels, one of which is an adjacent insulation panel adjacent to the first insulation panel. The first insulation panel also includes a starter portion that extends beyond at least the adjacent insulation panel of the additional panels.

BRIEF DESCRIPTION OF THE DRAWINGS

These and other features and advantages of the present invention will become better understood with regard to the following description and accompanying drawings in which.

DETAILED DESCRIPTION

Figure 1B:
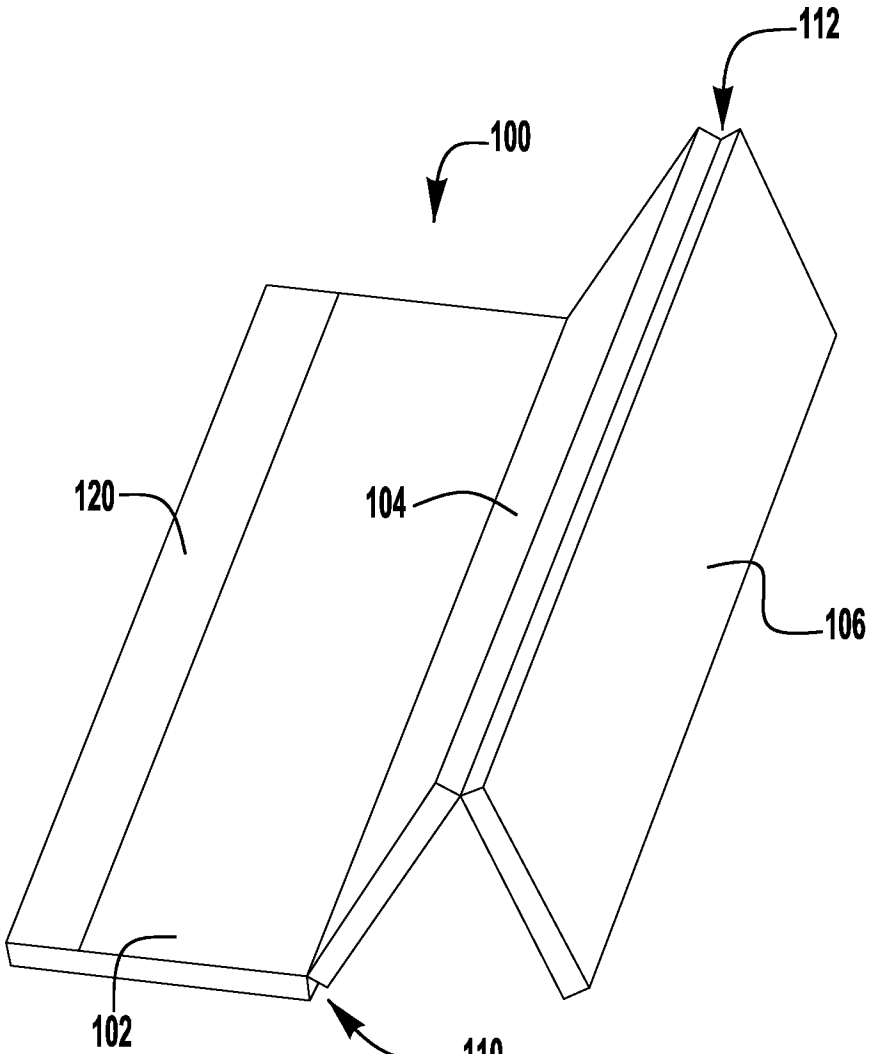
FIG. 1B is a perspective view of the foam insulation board of FIG. 1A in a partially unfolded configuration.
Figure 1A:
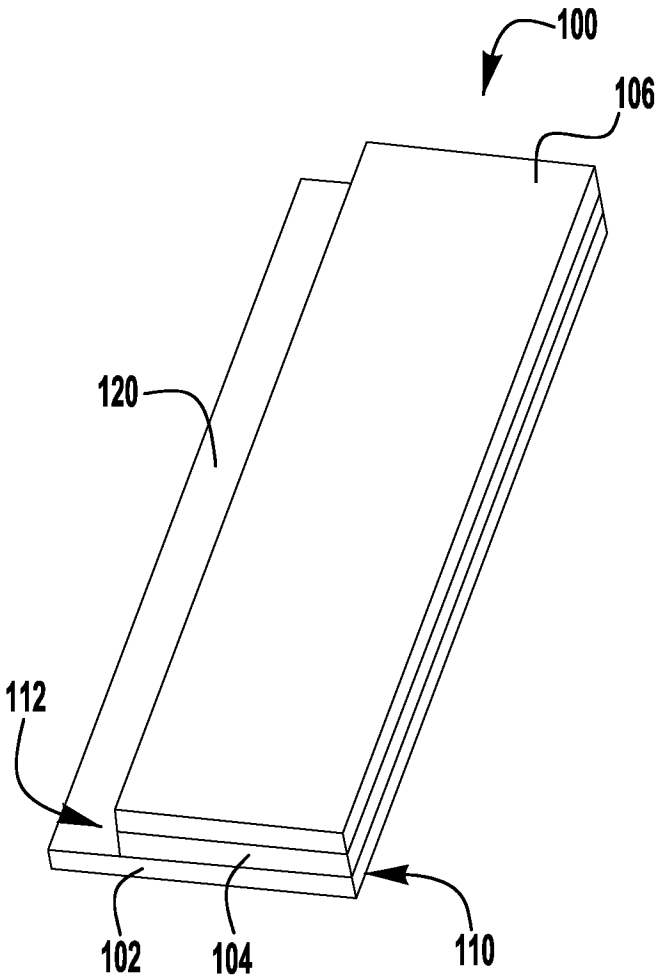
FIG. 1A is a perspective view of an exemplary foam insulation board in a folded configuration.
Figure 1C:
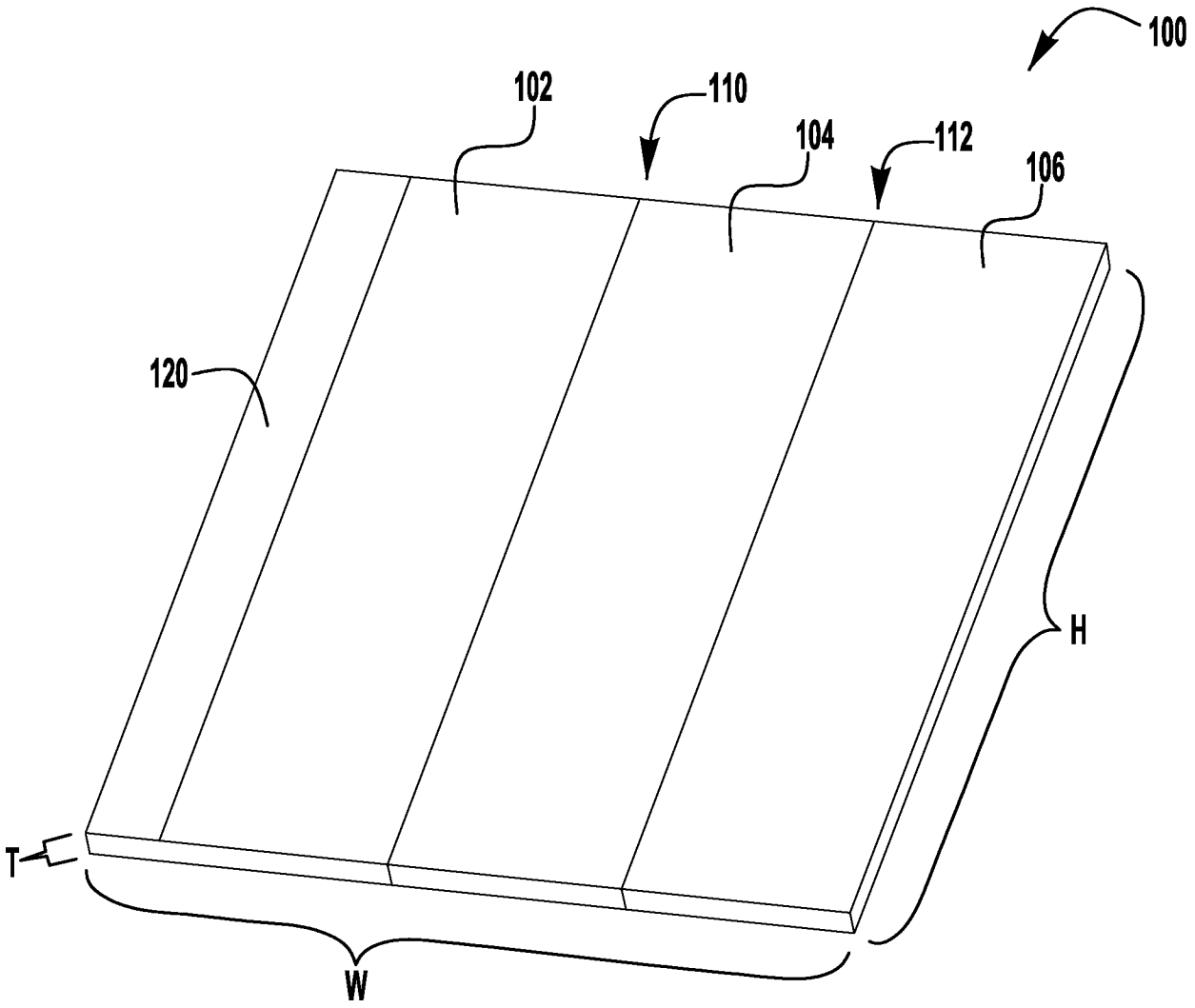
FIG. 1C is an isometric view of the foam insulation board of FIG. 1A in an unfolded configuration.

FIGS. 1A, 1B, and 1C illustrate an exemplary embodiment of a foam insulation board 100. The foam insulation board 100 is a rectangular board that can be folded at substantially parallel hinged portions into a folded configuration (FIG. 1A) and an unfolded configuration (FIG. 1C). In the unfolded configuration, the insulation board 100 may be about 4 feet wide by 8 feet high or about 4 feet wide by 9 feet high. The width (W) and height (H) of the panel may be varied to suit different wall heights and widths. The foam insulation board 100 comprises three hingeably connected panels: a first panel 102, a second panel 104, and a third panel 106. While three panels are shown, additional panels may be included. For example, the board may have a similar overall width but be divided into more than three panels, each panel having a reduced width as compared to the first, second, and third panels 102, 104, 106. Alternatively, the overall width of the unfolded board may be increased by adding additional panels, for example, additional panels that are attached to board 100 adjacently to the third panel 106 or between the second and third panels 104, 106.

The thickness (T) of the board 100 can vary depending on the desired insulation properties. For example, the board may be about 0.5 inch thick, about 0.75 inch thick, or about 1 inch thick. In some exemplary embodiments, the foam insulation board 100 is a polystyrene foam board, such as an extruded polystyrene foam board or an expanded polystyrene foam board. The board 100 may also include an air barrier, an air and moisture barrier, and/or an air barrier and moisture retarder on one or both sides. Air and moisture barriers prevent air or moisture from passing through the panels, while a moisture retarder allows moisture to pass through the panel to prevent moisture build-up. These elements of an exemplary board may be selected by a building designer for various reasons, such as, for example, to improve the efficiency of a heating and air conditioning systems installed in the building.

The panels 102, 104, 106 are hingeably connected by first and second hinged portions 110, 112. The first and second panels 102, 104 are hingeably connected by the first hinged portion 110, and the second and third panels 104, 106 are hingeably connected by the second hinge portion 112. The board 100 is unfolded from the folded configuration in one motion during which the second and third panels 104, 106 are unfolded from the first panel 102 along the first hinged portion 110 while simultaneously being unfolded from each other along the second hinged portion 112 to be laid flat in the same plane as the first panel 102. FIGS. 1A, 1B, and 1C illustrate the unfolding of the insulation board 100 with an intermediate step shown in FIG. 1B to more clearly indicate how the board 100 may appear during the unfolding process.

In the folded configuration, the first panel 102 extends beyond the second and third panels 104, 106 to form an optional starter portion 120. The starter portion 120 is exposed when board is in the folded configuration to allow an installer to begin installation of the board without unfolding the board. In the folded configuration, the panels 102, 104, 106 lay flat in a stacked configuration, one on top of the other, as shown in FIG. 1A, to reduce the overall size of the foam board 100. The reduced size of the folded board 100 improves transportation to the job site and handling during installation as compared to a full size board that cannot be folded.

In the illustrated embodiment, the first panel 102 is wider than the second and third panels 104, 106 to provide for the starter portion 120 and the second and third panels 104, 106 are approximately equal in width. For example, in a board 100 that is 4 feet (48 inches) wide, the first panel 102 may be 18 inches wide while the second and third panels 104, 106 may be 15 inches wide, allowing for a 3 inch wide starter portion 120. In additional embodiments, however, the second and third panels 104, 106 may have different widths than one another, with the first panel 102 being wider than each of the second and third panels 104, 106 to provide for the starter portion 120.

The first and second hinged portions 110, 112 can be any kind of hinge that allows the panels 102, 104, 106 to lay flat in a stacked configuration, one on top of the other, as shown in FIG. 1A, when the board is in the folded configuration. For example, the panels may be separate parts that are joined with adhesive tape (not shown) or a hinge member (not shown). The hinge portions 110, 112 may also be formed by cutting nearly through one side of the foam insulation board 100, leaving a portion near the surface of the board 100 to operate as a hinge portion 110, 112. The hinge portions 110, 112 may also be bidirectional or unidirectional. That is, the hinge portions 110, 112 may allow the panels 102, 104, 106 to fold in both directions or only in one direction to lay flat upon one another in a stacked configuration. The hinge portions 110, 112 may act as an air barrier, sealing the panels 102, 104, 106 together.

In some embodiments, retaining portions (not shown) may be included on the surface of the panels 102, 104, 106 to prevent the panels 102, 104, 106 of the board 100 from unfolding until desired. The retaining portions are easily released, however, when the panels 102, 104, 106 are intentionally unfolded for installation of the board 100. In some embodiments, the retaining portions are released by applying force to unfold the panels 102, 104, 106. In some other embodiments, a releasing member (not shown) may be used to release the releasing portions and allow the board 100 to be unfolded. In these embodiments, the retaining portions may be located anywhere the panels 102, 104, 106 contact each other. The retaining portions can be any kind of retaining portion, such as, for example, non-permanent adhesive or other tacky substance, double-sided tape, hook and loop fastener, a mechanical latch, or the like.

In various embodiments, a retaining member (not shown) is secured to the exterior of the board 100 in the folded configuration. The retaining member is then untied, cut, or otherwise removed to allow the board 100 to be unfolded. The external retaining member may comprise one or more straps that wrap around the entire folded board 100 or may comprise one or more straps that connect any combination of the panels 102, 104, 106. In other various embodiments, the retaining members may be fasteners that penetrate the panels 102, 104, 106 to prevent the board 100 from unfolding. If a penetrating retaining member (not shown) is used, however, the resulting hole may require patching to maintain the insulation performance of the board 100.

Figure 2A:
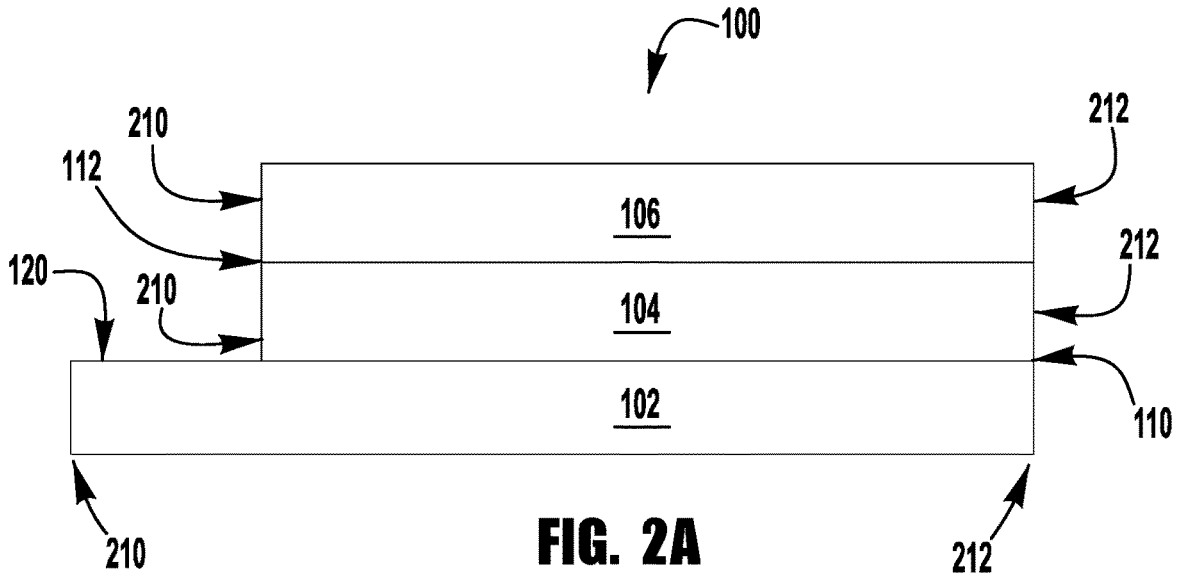
FIG. 2A is an end view of an exemplary foam insulation board.
Figure 2B:
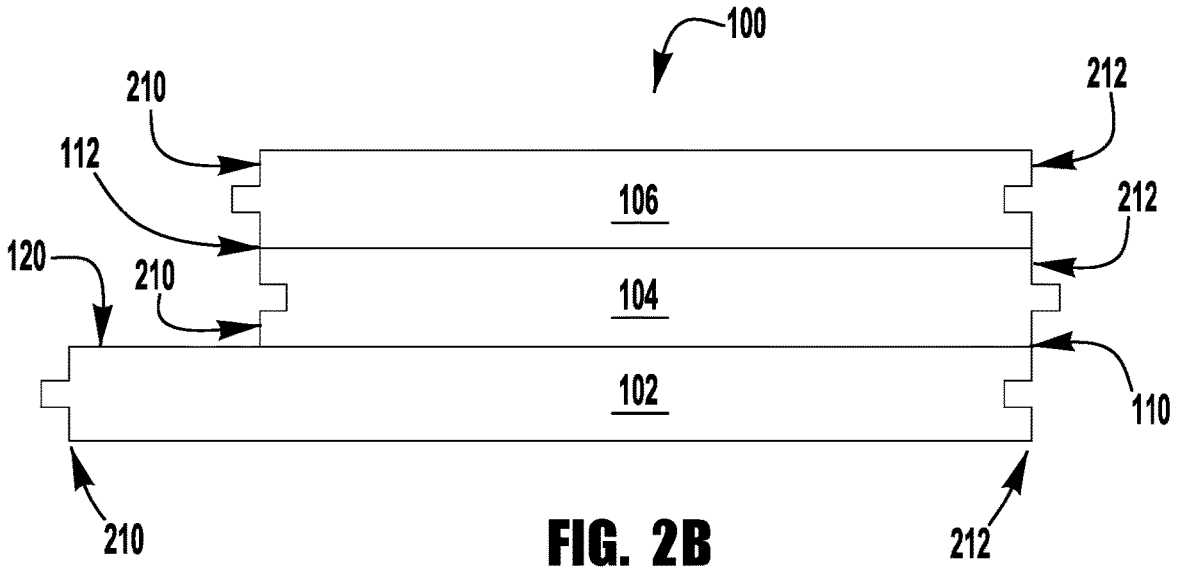
FIG. 2B is an end view of an exemplary foam insulation board.

FIGS. 2A and 2B show an end view of the insulation board 100 in the folded configuration. Each panel 102, 104, 106 has a first end 210 and a second end 212. When the board is unfolded into the unfolded configuration, the first end 210 of one panel interfaces with the second end 212 of an adjacent panel. As can be seen in FIG. 2A, the first and second ends 210, 212 of the panels 102, 104, 106 are flat and form a butt joint when the board 100 is unfolded. In other embodiments, as seen in FIG. 2B, the first end 210 comprises a tongue portion and the second end 212 comprises a groove portion, thereby forming a tongue and groove joint when the board 100 is unfolded. While the tongue and groove of the first end 210 and second end 212 in FIG. 2B are shown with a square shaped profile, any shape profile may be used, such as, for example, a triangular profile, a trapezoidal profile, a round profile, or the like. The ends 210, 212 do not have to be square and in some embodiments allow the board 100 to include a corner portion (not shown) when unfolded.

Figure 3A:
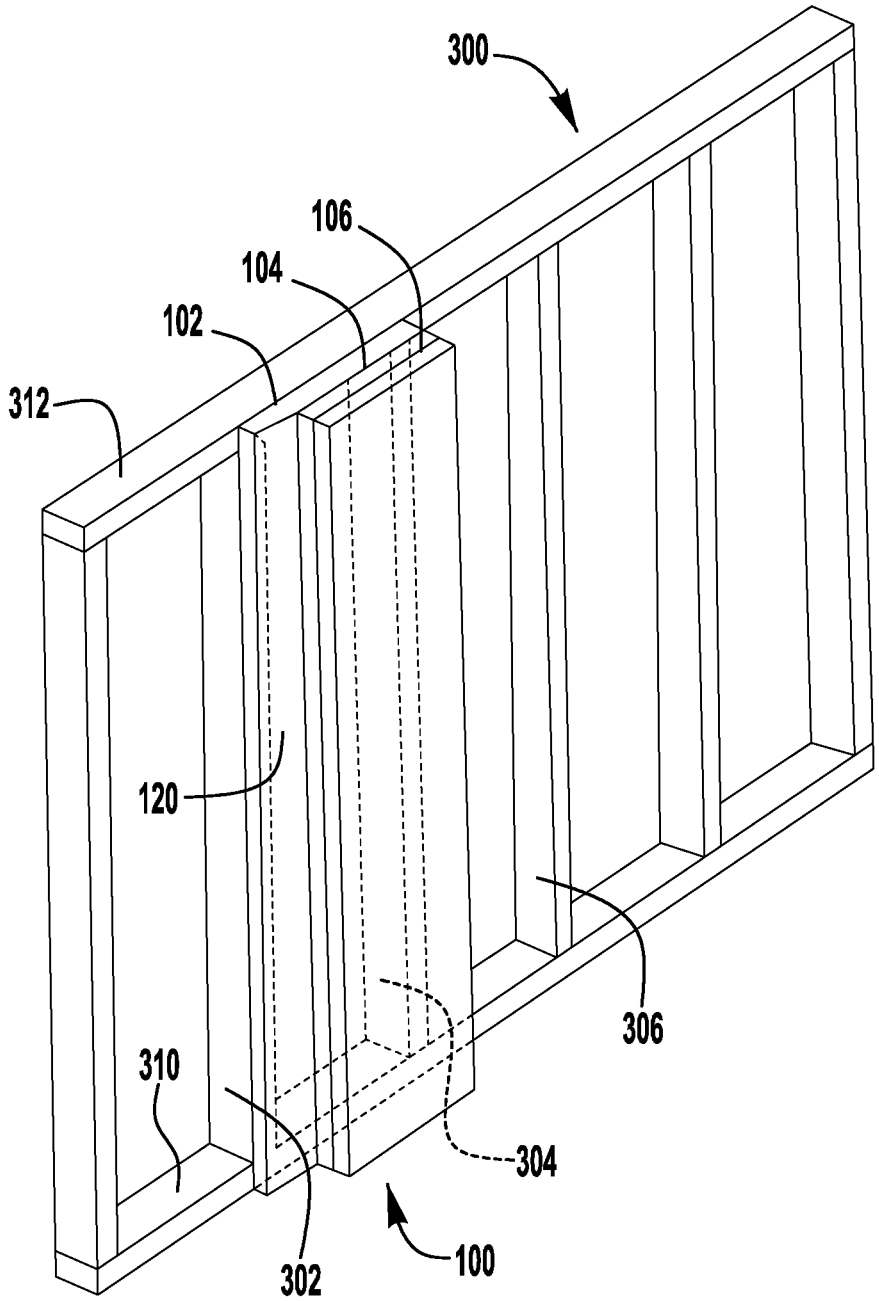
FIGS. 3A, 3B, and 3C are perspective views of the steps of an exemplary method for installing an exemplary foam insulation board.
Figure 3B:
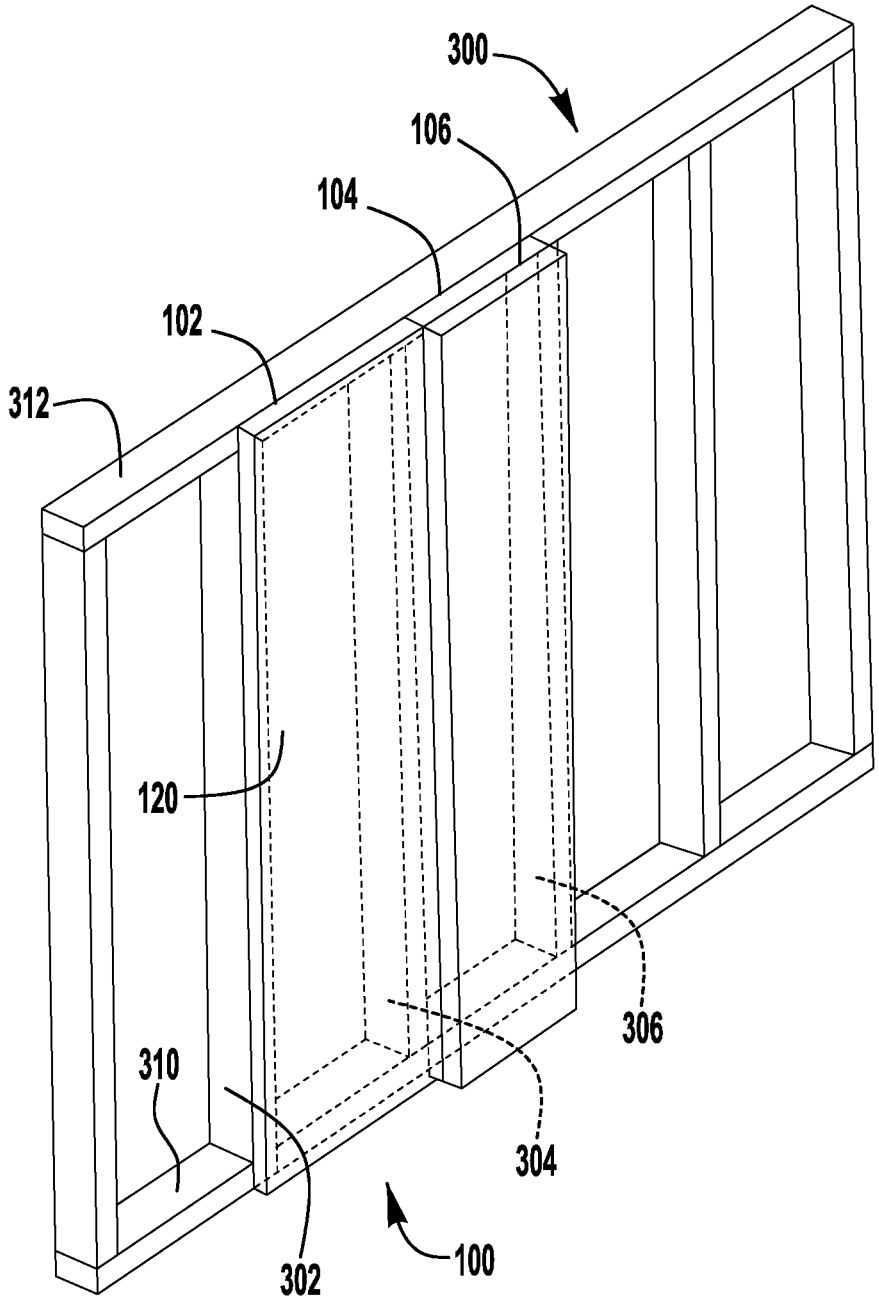
Figure 3C:
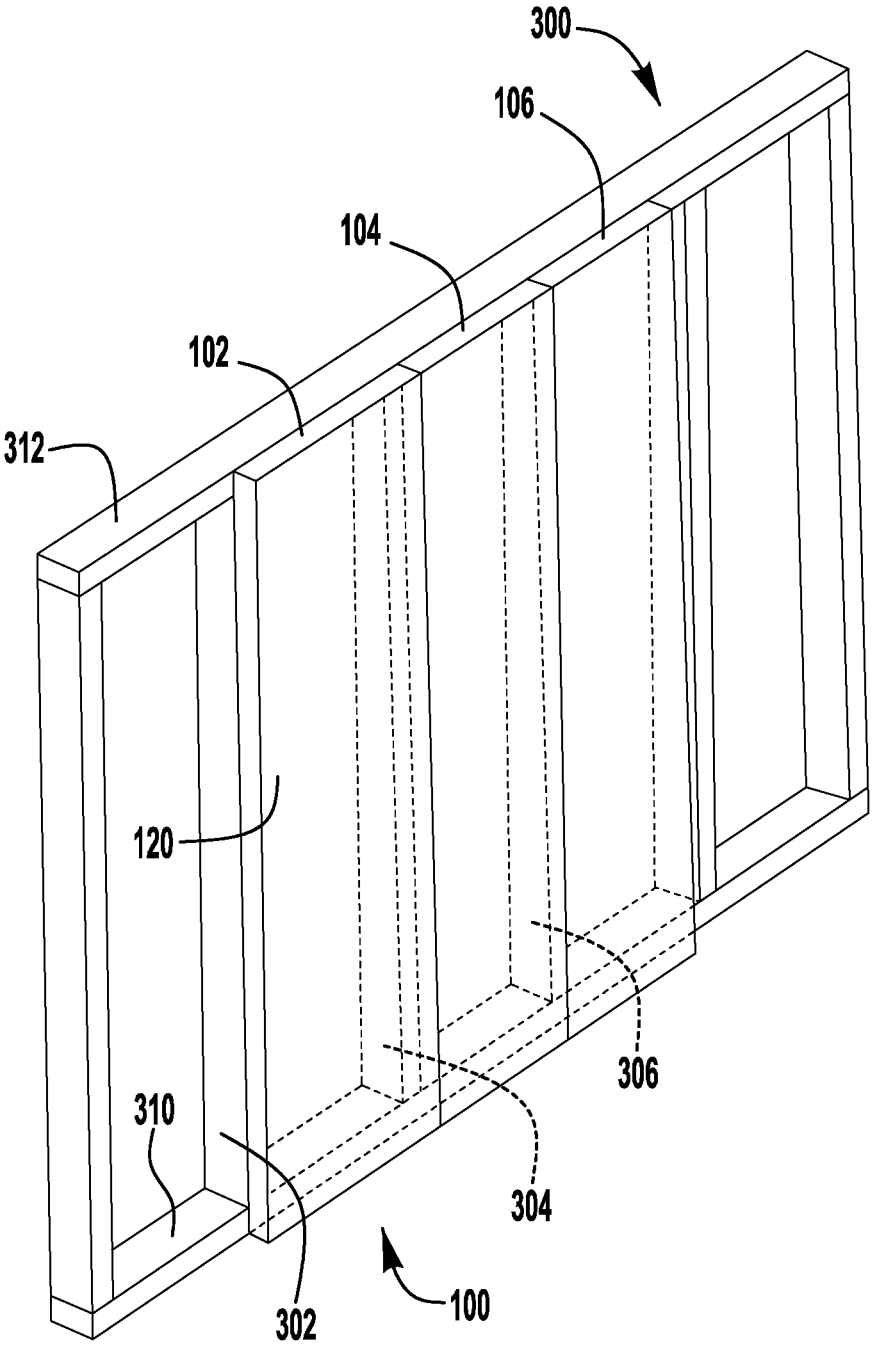

FIGS. 3A, 3B, and 3C illustrate the steps to affix an exemplary foam insulation board 100 to a framed wall 300 typical of a residential structure. The framed wall 300 is comprised of a plurality of framing members. In particular, vertical studs 302, 304, 306 are affixed to a bottom plate 310 and top plate 312. The studs are typically spaced approximately 16 inches apart on center. While a common wood frame wall is shown, the board 100 may be installed on any kind of interior or exterior wall of a structure if so desired by the builder or owner of the structure.

To install the foam insulation board 100, the installer holds the folded board 100 against the studs and secures the starter portion 120 of the first panel 102 to the wall using one or more fasteners (not shown). At this point, the board 100 is secured to the wall 300 and the installer can safely release the board 100 without risking damage or injury. In an embodiment of the board 100 including retention portions, such as adhesive portions, between the first, second, and third panels 102, 104, 106, safety of the installation procedure is further improved because the second and third panels 104, 106 are prevented from swinging out from the wall 300 after the starter portion 120 has been secured to the wall 300.

The installer continues installation by unfolding the board 100 until the second panel 104 and third panel 106 are flat against the wall 300. Additional fasteners are then used to secure the board 100 to the wall. The fasteners can be any kind of fasteners, such as, for example, nails, screws, adhesive, rivets, staples, or the like. The fasteners should be selected such that they securely affix the board 100 to the wall 300 without damaging the board 100. A combination of fasteners may also be used. For example, the board 100 may be glued to the wall 300 during installation and then further secured with nails.

Figure 4B:
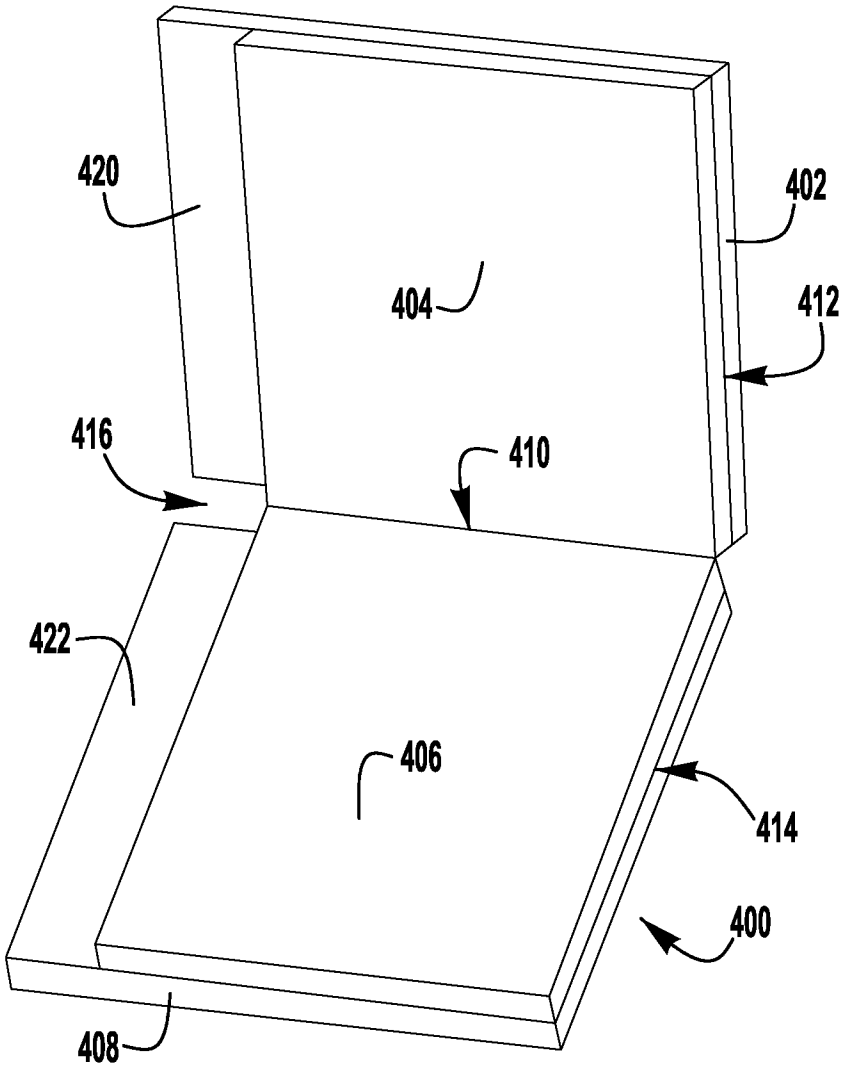
FIG. 4B is a perspective view of the foam insulation board of FIG. 4A in a partially unfolded configuration.
Figure 4A:
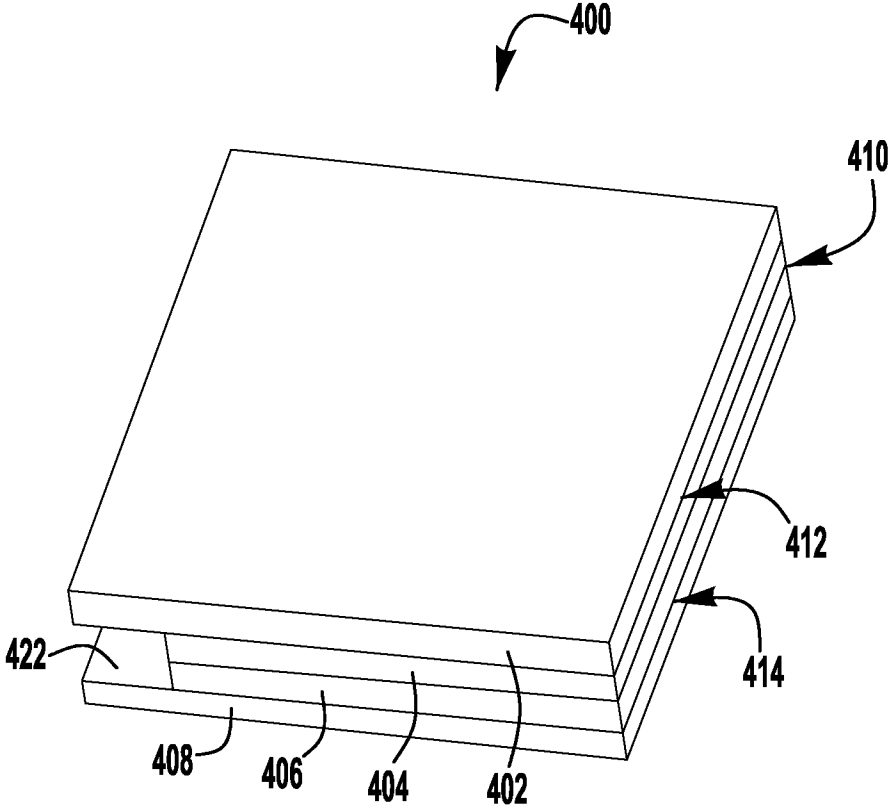
FIG. 4A is a perspective view of an exemplary foam insulation board in a folded configuration.
Figure 4D:
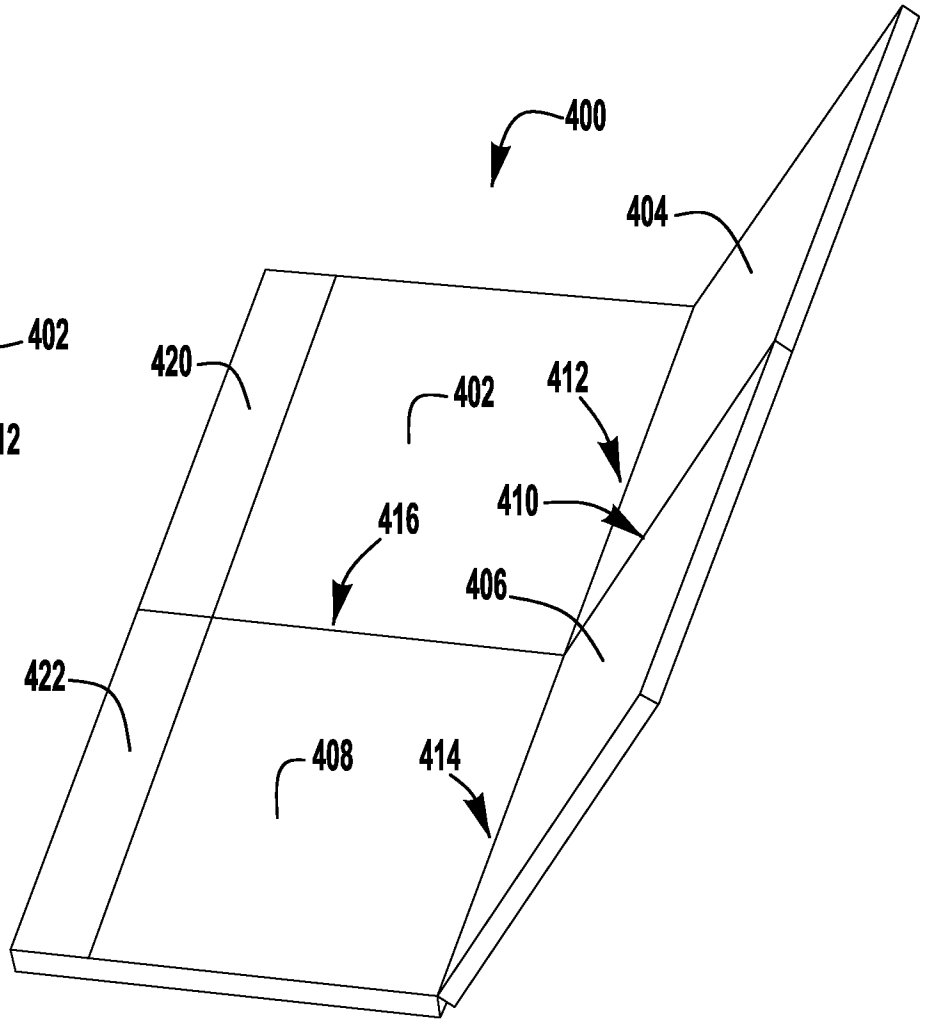
FIG. 4D is a perspective view of the foam insulation board of FIG. 4A in a partially unfolded configuration.
Figure 4C:
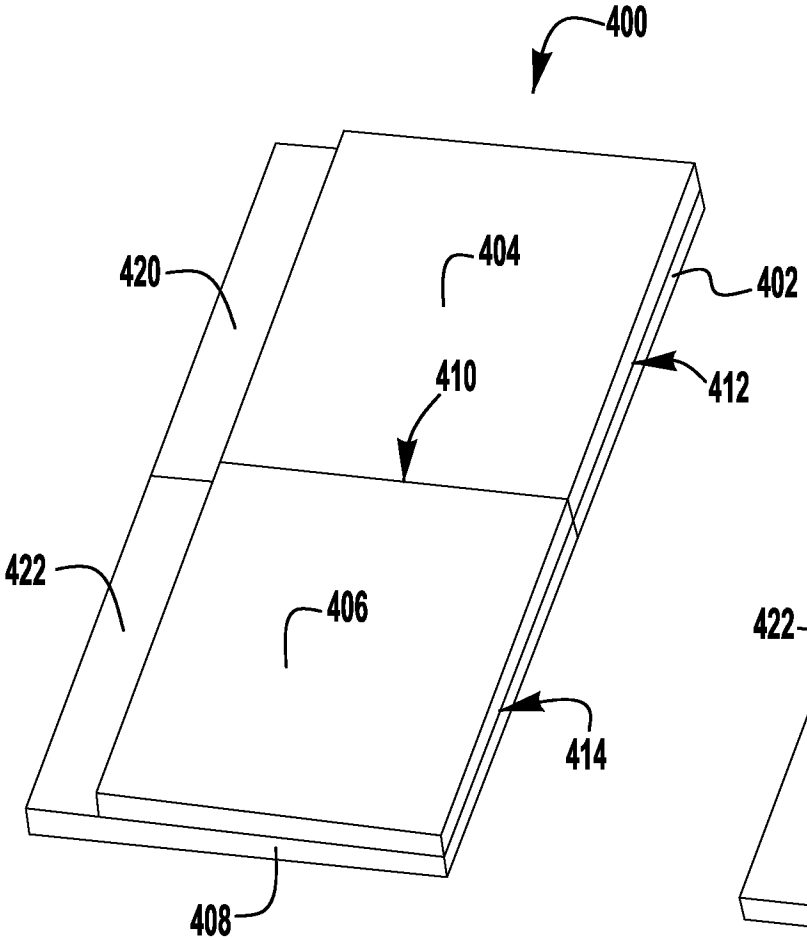
FIG. 4C is a perspective view of the foam insulation board of FIG. 4A in an intermediate unfolded configuration.
Figure 4E:
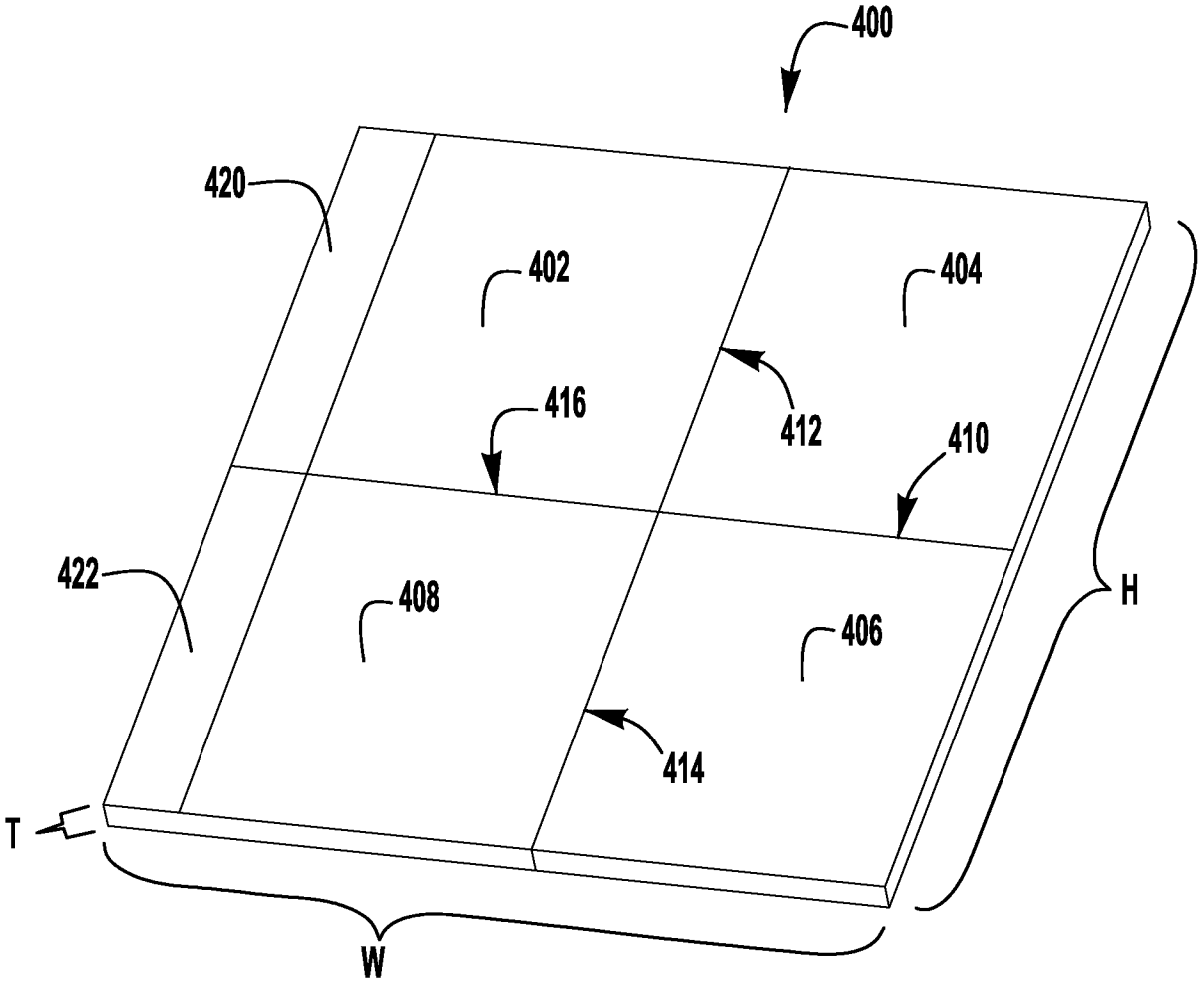
FIG. 4E is a perspective view of the foam insulation board of FIG. 4A in an unfolded configuration.

FIGS. 4A, 4B, 4C, 4D, and 4E illustrate an exemplary embodiment of a foam insulation board 400. The foam insulation board 400 is a rectangular board that can be folded at substantially perpendicular hinged portions into a folded configuration (FIG. 4A) and an unfolded configuration (FIG. 4E). The foam insulation board 400 comprises four hingeably connected panels: a first panel 402, a second panel 404, a third panel 406, and a fourth panel 408. While four panels are shown, additional panels may be included. For example, the board may have a similar overall width but be divided into more than four panels, each panel having a reduced width or height as compared to the first, second, third, and fourth panels 402, 404, 406, 408. Alternatively, the overall width of the unfolded board may be increased by adding additional panels between, for example, the first and second panels 402, 404 and the third and fourth panels, 406, 408, or attached to the board 400 adjacently to second panel 404 and fourth panel 408.

The thickness of the foam insulation board 400 can vary depending on the desired insulation properties. For example, the board may be about 0.5 inch thick, about 0.75 inch thick, or about 1 inch thick. In some exemplary embodiments, the foam insulation board 400 is a polystyrene foam board, such as an extruded polystyrene foam board or an expanded polystyrene foam board. The board 400 may also include a moisture vapor barrier on one or both sides.

The panels 402, 404, 406, 408 are hingeably connected by first, second, and third hinged portions 410, 412, 414. The first panel 402 and second panel 404 are hingeably connected by the second hinged portion 412. The second panel 404 and the third panel 406 are connected by the first hinged portion 410. The third panel 406 and fourth panel 408 are connected by the third hinged portion 414. The second and third hinged portions 412, 414 are substantially aligned, while the first hinged portion 410 is substantially perpendicular to the second and third hinged portions 412, 414. The addition of a perpendicular hinged portion allows the insulation board 400 to be folded in two different directions, thereby further reducing the length and width of the folded configuration of the board 400 to allow for transportation in smaller vehicles or insertion through smaller openings in a building prior to installation.

In the folded configuration, the first panel 402 and fourth panel 408 extend beyond the second and third panels 404, 406 to form first and second starter portions 420, 422. Because the board 400 is folded in two directions, however, the starter portions 420, 422 may obstruct each other when the board 400 is fully folded. Thus, depending on the fastener used, an installer may need to partially unfold the board 400 to secure one of the starter portions 420, 422 to a wall. Alternatively, the first and fourth panels 402, 408 may fold in different directions along the second and third hinged portions 412, 414 so that the first starter portion 420 extends from a different side of the folded foam insulation board than the second starter portion 422.

The first and fourth panels 402, 408 are wider than the second and third panels 404, 406 to provide for the starter portions 420, 422. The first and fourth panels 402, 408 are approximately equal in width, and the second and third panels 404, 406 are approximately equal in width. For example, in an insulation board 400 that is 4 feet (48 inches) wide, the first and fourth panels 402, 408 may be 26 inches wide while the second and third panels 404, 406 may be 22 inches wide, allowing for a 4 inch wide starter portion 420.

The insulation board 400 is unfolded by first unfolding the first and second panels 402, 404 from the second and third panels 406, 408 along the first hinged portion 410 until the first panel 402 is aligned with the fourth panel 408 and the second panel 404 is aligned with the third panel 406. In this intermediate unfolded configuration, the first and second starter portions 420, 422 are easily accessible by an installer. The second and third panels 404, 406 are then unfolded from the first and fourth panels 402, 408 along the second and third hinged portions 412, 414 until they lie flat and are aligned with the first and fourth panels 402, 408 in the unfolded configuration. Like the foam insulation board 100 discussed above, the foam insulation board 400 with four panels may also be secured in the folded configuration by retention portions (not shown) or retaining members (not shown).

The hinged portions 410, 412, 414 can be any kind of hinge that allows the panels 402, 404, 406, 408 to lay flat in the stacked configuration, one on top of the other, as illustrated in FIG. 4A when the board 400 is in the folded configuration. For example, the panels may be separate parts that are joined with adhesive tape (not shown) or a hinge member (not shown). The hinge portions 410, 412, 414 may also be formed by cutting nearly through one side of the foam insulation board 400, leaving a portion near the surface of the board 400 to operate as a hinge portion 410, 412, 414. The hinge portions 410, 412, 414 may also be bidirectional or unidirectional. That is, the hinge portions 410, 412, 414 may allow the panels 402, 404, 406, 408 to fold in both directions or only in one direction to lay flat upon one another in a stacked configuration.

The foam insulation board 400 is installed similar to the foam insulation board 100 shown in FIGS. 3A, 3B, and 3C. The starter portion 400 is first secured to a wall, and then the board 400 is unfolded and the remaining panels are secured to the wall. As with the foam insulation board 100, any kind of suitable fastener may be used to secure the foam insulation board 400 to a wall.

While various inventive aspects, concepts and features of the disclosures may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts and features of the disclosures—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present application even if such embodiments are not expressly disclosed herein. Additionally, even though some features, concepts or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated. Moreover, while various aspects, features and concepts may be expressly identified herein as being inventive or forming part of an disclosure, such identification is not intended to be exclusive, but rather there may be inventive aspects, concepts and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements. Also as described herein, the terms "substantially" and "about" are defined as at least close to (and includes) a given value or state (preferably within 10% of, more preferably within 1% of, and most preferably within 0.1% of).

What is claimed is:

1. A method of installing insulation, the method comprising:

providing a foam insulation board comprising:

a first insulation panel having a starter portion; and a second insulation panel, wherein the first insulation panel and the second insulation panel are connected to one another by a first hinged portion;

wherein the foam insulation board has an unfolded and a folded configuration;

wherein the first hinged portion allows the first insulation panel and the second insulation panel to fold flat against each other when the foam insulation board is in the folded configuration; and wherein a width of the first insulation panel is greater than a width of the second insulation panel, such that the starter portion of the first insulation panel extends beyond the second insulation panel;

securing the starter portion of the foam insulation board to at least a portion of a framed wall when the foam insulation board is in the folded configuration;

unfolding the foam insulation board into the unfolded configuration; and securing the foam insulation board to the framed wall.

2. The method of installing insulation of claim 1, wherein a length of the second insulation panel is the same as the length of the first insulation panel.

3. The method of installing insulation of claim 1, wherein the foam insulation board further comprises a third insulation panel;

wherein the second insulation panel and the third insulation panel are connected to one another by a second hinged portion;

wherein the second hinged portion allows the second insulation panel and the third insulation panel to fold flat against each other when the foam insulation board is in the folded configuration; and wherein the first hinged portion and the second hinged portion are parallel to one another.

4. The method of installing insulation of claim 3, wherein a width of the third insulation panel is the same as the width of the second insulation panel.

5. The method of installing insulation of claim 3, wherein a length of the third insulation panel is the same as a length of the first insulation panel.

6. The method of installing insulation of claim 3, wherein the foam insulation board further comprises a fourth insulation panel;

wherein the third insulation panel and the fourth insulation panel are connected to one another by a third hinged portion;

wherein the third hinged portion allows the third insulation panel and the fourth insulation panel to fold flat against each other when the foam insulation board is in the folded configuration; and wherein the second hinged portion and the third hinged portion are parallel to one another.

7. The method of installing insulation of claim 6, wherein a width of the fourth insulation panel is the same as the width of the third insulation panel.

8. The method of installing insulation of claim 6, wherein a width of the fourth insulation panel is the same as a width of the first insulation panel.

9. The method of installing insulation of claim 6, wherein a length of the fourth insulation panel is the same as the length of the first insulation panel.

10. The method of installing insulation of claim 1, wherein the first insulation panel and the second insulation panel are joined by tongue and groove joints when the foam insulation board is in the unfolded configuration.

11. The method of installing insulation of claim 1, wherein the foam insulation board further comprises at least one retention member that retains the foam insulation board in the folded configuration.

12. The method of installing insulation of claim 11, wherein the at least one retention portion comprises an adhesive applied to a face of at least one of the first insulation panel and second insulation panel.

13. The method of installing insulation of claim 1, wherein the first insulation panel includes a first sub-panel and a second sub-panel;

wherein the first sub-panel and the second sub-panel are connected to one another by a fourth hinged portion; and wherein the fourth hinged portion is perpendicular to the first hinged portion.

14. The method of claim 1, wherein the step of securing the starter portion of the foam insulation board requires the use of one or more fasteners selected from nails, screws, rivets, or an adhesive.

15. The method of claim 1, wherein the foam insulation board is secured vertically to the framed wall.

16. The method of claim 1, wherein the starter portion extends along 100 percent of a lengthwise edge of the first insulation panel.

17. The method of claim 1, wherein the starter portion extends along at least 90 percent of a lengthwise edge of the first insulation panel.

18. The method of claim 1 wherein the starter portion extends along at least 75 percent of a lengthwise edge of the first insulation panel.

19. A method of installing insulation, the method comprising:

providing a foam insulation board comprising:

a first insulation panel including a first sub-panel and a second sub-panel;

wherein the first sub-panel includes a first starter portion;

wherein the second sub-panel includes a second starter portion; and a second insulation panel;

wherein the first insulation panel and the second insulation panel are connected to one another by a first hinged portion;

wherein the first sub-panel and the second sub-panel are connected to one another by a second hinged portion; and wherein the second hinged portion is perpendicular to the first hinged portion;

wherein the foam insulation board has an unfolded and a folded configuration;

wherein the first hinged portion allows the first insulation panel and the second insulation panel to fold flat against each other when the foam insulation board is in the folded configuration;

wherein a width of the first insulation panel is greater than a width of the second insulation panel, such that the starter portion of the first insulation panel extends beyond the second insulation panel;

securing the starter portion of the foam insulation board to at least a portion of a framed wall when the foam insulation board is in the folded configuration using one or more fasteners selected from: nails, screws, rivets, and an adhesive;

unfolding the foam insulation board into the unfolded configuration; and securing the foam insulation board to the framed wall.

20. A method of installing insulation, the method comprising:

providing a foam insulation board comprising:

a first insulation panel including a first sub-panel and a second sub-panel;

wherein the first sub-panel includes a first starter portion;

wherein the second sub-panel includes a second starter portion; and wherein a gap exists between the first starter portion and the second starter portion when the foam insulation board is in the unfolded configuration; and a second insulation panel;

wherein the first insulation panel and the second insulation panel are connected to one another by a first hinged portion;

wherein the first sub-panel and the second sub-panel are connected to one another by a second hinged portion; and wherein the second hinged portion is perpendicular to the first hinged portion;

wherein the foam insulation board has an unfolded and a folded configuration;

wherein the first hinged portion allows the first insulation panel and the second insulation panel to fold flat against each other when the foam insulation board is in the folded configuration;

wherein a width of the first insulation panel is greater than a width of the second insulation panel, such that the starter portion of the first insulation panel extends beyond the second insulation panel;

securing the starter portion of the foam insulation board to at least a portion of a surface when the foam insulation board is in the folded configuration;

unfolding the foam insulation board into the unfolded configuration; and securing the foam insulation board to the surface.

* * * * *